US007455947B2

(12) United States Patent
Ida et al.

(10) Patent No.: US 7,455,947 B2
(45) Date of Patent: Nov. 25, 2008

(54) YELLOW TONER, IMAGE FORMING APPARATUS AND A METHOD FOR PRODUCING A TONER

(75) Inventors: Tetsuya Ida, Mishima (JP); Yasuhiro Ichikawa, Kawasaki (JP); Wakashi Iida, Toride (JP); Yojiro Hotta, Abiko (JP); Kazuhiko Hayami, Toride (JP); Hirohide Tanikawa, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/753,081

(22) Filed: May 24, 2007

(65) Prior Publication Data

US 2007/0224531 A1 Sep. 27, 2007

Related U.S. Application Data

(62) Division of application No. 10/980,252, filed on Nov. 4, 2004.

(30) Foreign Application Priority Data

Nov. 7, 2003 (JP) ..... 2003-378736

(51) Int. Cl.
*G03G 9/08* (2006.01)

(52) U.S. Cl. ..... 430/137.8; 430/137.1

(58) Field of Classification Search ..... 430/137.18, 430/137.1

See application file for complete search history.

(56) References Cited

U.S. PATENT DOCUMENTS

| | | | | |
|---|---|---|---|---|
| 5,652,075 | A | 7/1997 | Kanbayashi et al. | |
| 5,853,929 | A | 12/1998 | Campbell | |
| 5,885,739 | A | 3/1999 | Dalal et al. | 430/107.1 |
| 5,912,099 | A | 6/1999 | Kanbayashi et al. | |
| 6,022,659 | A | 2/2000 | Kanbayashi et al. | 430/106 |
| 6,495,302 | B1 * | 12/2002 | Jiang et al. | 430/137.14 |
| 6,582,873 | B2 | 6/2003 | Jiang et al. | 430/137.14 |
| 6,664,016 | B2 * | 12/2003 | Kanbayashi et al. | 430/108.23 |
| 6,780,559 | B2 | 8/2004 | Vèregin et al. | 430/137.14 |
| 7,229,727 | B2 | 6/2007 | Itakura et al. | 430/450 |
| 2002/0048712 | A1 | 4/2002 | Kuroda et al. | |
| 2002/0048713 | A1 | 4/2002 | Komoto et al. | |
| 2003/0096183 | A1 * | 5/2003 | Katoh et al. | 430/108.6 |
| 2003/0162118 | A1 | 8/2003 | Komatsu et al. | |

(Continued)

FOREIGN PATENT DOCUMENTS

| | | |
|---|---|---|
| EP | 0720063 | 7/1996 |

(Continued)

*Primary Examiner*—Hoa V Le
(74) *Attorney, Agent, or Firm*—Fitpatrick, Cella, Harper & Scinto

(57) ABSTRACT

The present invention provides a yellow toner which is excellent in transparency of an image formed on an OHP sheet, excellent in color reproducibility even when a light-pressure fixing unit is employed, excellent in coloring power and charge property, and is reduced in occurrence of filming. The present invention also provides a yellow toner having excellent durability and capable of contributing to the simplification or miniaturization of the constitution of an image forming apparatus.

The yellow toner of the invention comprises a binder resin and a colorant, the binder resin contains at least a polyester unit, and the toner in the powder state has a lightness L* satisfying the relationship of L*>87 and has a chromaticity b* satisfying the relationship of 106<b*<120.

3 Claims, 1 Drawing Sheet

U.S. PATENT DOCUMENTS

| | | | | |
|---|---|---|---|---|
| 2003/0207186 | A1 | 11/2003 | Itakura et al. | 430/45 |
| 2004/0209178 | A1 | 10/2004 | Itakura et al. | 430/45 |
| 2007/0031747 | A1 | 2/2007 | Itakura et al. | 430/450 |

FOREIGN PATENT DOCUMENTS

| | | |
|---|---|---|
| EP | 0822460 | 2/1998 |
| EP | 0984331 | 3/2000 |
| EP | 1143303 | 10/2001 |
| EP | 1182513 | 2/2002 |
| EP | 1329774 | 7/2003 |
| EP | 1336903 | 8/2003 |
| JP | 06-161154 | 6/1994 |
| JP | 07-028277 | 1/1995 |
| JP | 07-128911 | 5/1995 |
| JP | 06-148937 | 5/1997 |
| JP | 09-258487 | 10/1997 |
| JP | 2910945 | 4/1999 |
| JP | 2002-129089 | 5/2002 |
| WO | WO 95/00885 | 1/1995 |

* cited by examiner

YELLOW TONER, IMAGE FORMING APPARATUS AND A METHOD FOR PRODUCING A TONER

This application is a division of U.S. application Ser. No. 10/980,252, filed on Nov. 11, 2004, which claims priority from Japanese Patent Application No. 2003-378736 filed Nov. 7, 2003. The disclosures of the prior applications are incorporated by reference herein in their entirety.

BACKGROUND OF THE INVENTION

1. Field of the Invention

The present invention relates to a yellow toner used for an image forming method such as an electrophotographic method, an electrostatic recording method, electrostatic printing method, or toner jet recording method; and an image forming apparatus using the yellow toner. The present invention is particularly suited for an image forming method using an oil-less fixing method.

2. Description of the Related Art

In full-color copying machines or printers, a desired color image is formed by using a cyan toner, a magenta toner, a yellow toner and a black toner, developing a latent image by superimposing the toners utilizing subtractive color mixing, transferring the respective toner images, which have been formed by the development, on a transfer material such as OHP sheet or plain paper to make the respective toner images should be finally superimposed, and then fixing the superimposed toner images onto the transfer material. Color toners therefore must have transparency so that the color of the upper toner layer does not disturb the color of the lower toner layer upon mixing. When the toner has poor transparency, the chromaticity of a projected image formed on an overhead projector (OHP) sheet changes, which prevents the formation of a desired color; or a color reproduction range becomes narrow because the color of the lower toner layer does not appear when the toners are superimposed. On-demand fixing system which hardly consumes energy during standby has recently been preferred from the ecological point of view. Compared with the ordinary roller fixing system, fixing tends to be performed under light pressure when on-demand fixing system is adopted. If a toner with poor transparency is used with the on-demand fixing system, the range of color reproduction further may be narrow.

In recent years, copying machines or printers which are more compact, lighter in weight, speedier and more reliable have been required eagerly from the space-saving and energy-saving viewpoints. Accordingly, their hardware has come to be formed of simpler elements and toners have been required to have higher performances. Without improvement in the performances of toners, it has been difficult to form an image with excellent quality. For example, with regards to power sources having an important role in the constitution of the hardware, use of one developing bias for the development of respective colors enables a reduction in the number of necessary power sources. In order to attain this, it is necessary to control the chargeability of respective color toners to be uniform.

In the investigation of colors or chargeability of toner, it must be considered that people have a high sensitivity to variations in the hue angle, particularly, of a yellow toner among various color toners, and are susceptible to a change in the chromaticity of a transmitted light. The chargeability of the yellow toner is much higher than that of a cyan toner or magenta toner. It was therefore necessary to make efforts to reduce the amount of a yellow colorant to be added to a toner. With a view to overcoming such a problem, use of a monoazo yellow pigment represented by the below-described formula is desired because it is excellent in the reflected color and coloring power. However, it has not been utilized fully for the toner because primary particles of the pigment tend to cause crystal growth upon drying or heating after its synthesis, which adversely affects the transparency of the toner. Problems to be solved are suppression of the pigment agglomeration and growth of primary particles and dispersing the pigment in the toner without increasing the particle size of the pigment.

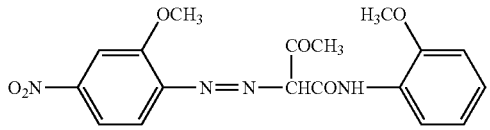

A technology of improving dispersibility of pigment by synthesizing a pigment, mixing the resulting pigment, which is not pulverized but is in the hydrate form (paste pigment), with a resin under heating, and pelletizing the mixture into dry pellets; or by mixing a pigment powder with water and a resin under heating, and then pelletizing the mixture into dry pellets is proposed (for example, in Japanese Patent No. 2910945, and JP 06-148937 A, JP 6-161154, and JP 2002-129089 A).

Improvement in pigment dispersibility by incorporating an additive to a pigment (for example, in JP 7-128911 A) or by incorporating an additive upon kneading of a pigment and a resin (for example, in JP 7-28277 A and JP 9-258487 A) is also proposed.

According to the investigation by the present inventors, however, the above-described method such as use of a pigment in the paste form, addition of water upon kneading of a resin and a pigment, or use of an additive upon kneading of a resin and a pigment cannot suppress the growth of the primary particles of the pigment completely and there is still room for improvement in the transparency or color hue. In addition, the toner available by the above-described method does not have adequate charge response or a chargeability which can be controlled to match with that of the other color toners. Incorporation of a dissimilar raw material (additive) in order to heighten dispersibility improves dispersibility but changes the tint of the pigment itself or causes filming to a photosensitive drum.

SUMMARY OF THE INVENTION

In consideration of the problems of the related art, the inventors have completed the present invention. An object of the present invention is to provide a yellow toner which is excellent in the transparency of an image formed over an OHP sheet, has excellent color reproducibility even fixed by a light-pressure fixing unit, has good coloring power and charge property, and causes less filming.

Another object of the present invention is to provide a yellow toner with excellent durability, which can contribute to the simplification or miniaturization of the constitution of an image forming apparatus.

A further object of the present invention is to provide an image forming apparatus suited for the use of the yellow toner.

A still further object of the present invention is to provide a method for producing the yellow toner.

The present invention will next be described.

(1) A yellow toner comprising a binder resin and a colorant, wherein:

the binder resin comprises at least a polyester unit, the toner in the powder state has a lightness L* satisfying the relationship of $L^*>87$ and has a chromaticity b* satisfying the relationship of $106<b^*<120$.

(2) The yellow toner of (1), wherein the colorant comprises a monoazo pigment.

(3) The yellow toner of (1), wherein the colorant comprises C.I. Pigment yellow 74.

(4) The yellow toner of (1), wherein in the number-basis particle diameter distribution of the colorant when the binder resin and the colorant are mixed upon producing the for producing the toner, a median particle diameter D is 100 nm or less, and frequency $D_{150}$ of particles having a particle diameter of 150 nm or more is 12% or less.

(5) An image forming apparatus comprising:

an image bearing member for bearing an electrostatic latent image;

a charging unit for charging the image bearing member;

a latent image forming unit for forming the electrostatic latent image on the image bearing member charged by the charging unit; and a developing unit for forming a toner image by developing the electrostatic latent image formed on the image bearing member with a toner, wherein:

the developing unit has a developing unit A for developing with a yellow toner, a developing unit B for developing with a toner other than the yellow toner, and a developing bias supply unit for applying a developing bias at the time of development, a developing bias upon development by the developing unit A and another developing bias upon development by the developing unit B are applied by the common developing bias supply unit; and the yellow toner comprises a binder resin and a colorant, the binder resin contains at least a polyester unit, and the toner in the powder state has a lightness L* satisfying the relationship of L*>87 and has a chromaticity b* satisfying the relationship of 106<b*<120.

(6) An image forming apparatus comprising:

an image bearing member for bearing an electrostatic latent image;

a charging unit for charging the image bearing member;

a latent image forming unit for forming the electrostatic latent image on the image bearing member charged by the charging unit;

a developing unit for forming a yellow toner image by developing the electrostatic latent image formed on the image bearing member with a yellow toner;

a transfer unit for transferring the yellow toner image to a transfer material; and a fixing unit having a rotary heating member and a rotary pressure member to be brought into contact with the rotary heating member under pressure and fixing the yellow toner image onto the transfer material by heating under pressure; wherein:

in the fixing unit, the rotary pressure member is pressured against the rotary heating member at a line pressure of from 490 to 980 N/m through the transfer member; and the yellow toner comprises a binder resin and a colorant, the binder resin contains at least a polyester unit, and the yellow toner in the powder state has a lightness L* satisfying the relationship of L*>87 and has a chromaticity b* satisfying the relationship of 106<b*<120.

(7) A method for producing a toner comprising steps of:

heating and mixing a colorant and a part of a binder resin in the presence of water to obtain a hydrated color masterbatch having a water content of from 5 to 25% by mass;

melt-kneading at least the hydrated color masterbatch and the remaining part of the binder resin to obtain a kneaded product; and pulverizing the kneaded product to obtain the toner.

(8) The method for producing a toner of (7), wherein the kneading temperature Tmix (° C.) of the resin in the step of melt-kneading satisfies the following expression:

$$Tmix \leqq Tm+20$$

wherein, Tm (° C.) is a softening point of the binder resin.

(9) The method for producing a toner of (7), wherein:

the toner comprises a binder resin and a colorant;

the binder resin contains at least a polyester unit; and the toner is yellow toner, which in the powder state has a lightness L* satisfying the relationship of L*>87 and has a chromaticity b* satisfying the relationship of 106<b*<120.

BRIEF DESCRIPTION OF THE DRAWINGS

Other objects and advantages of the present invention will become apparent during the following discussion conjunction with the accompanying drawings, in which.

DETAILED DESCRIPTION OF THE PREFERRED EMBODIMENT

Figure 1:
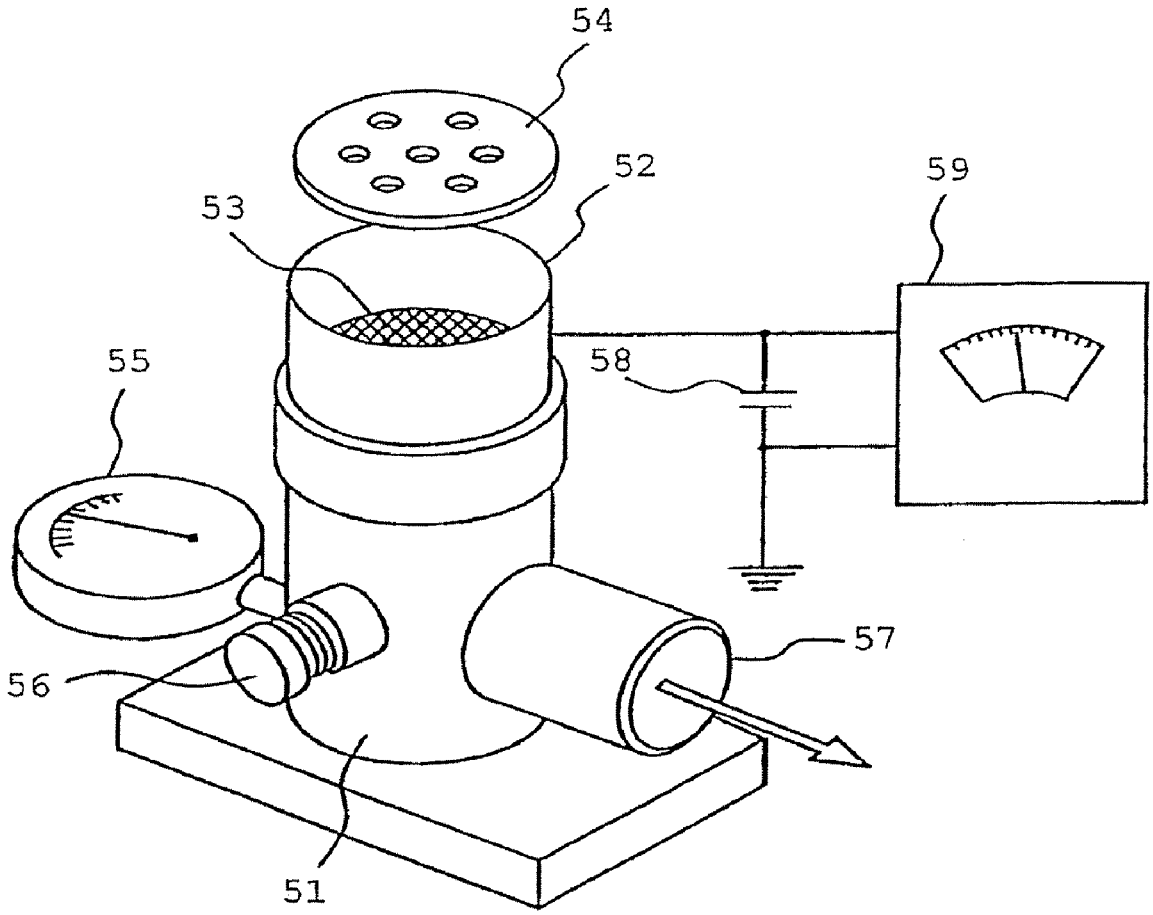
FIG. 1 is a schematic view of an apparatus for measuring a triboelectric charge.

The inventors have carried out an extensive investigation with a view to overcoming the above-described problems. As a result, it has been found that a toner having excellent transparency and coloring power and capable of contributing to the simplification and miniaturization of the constitution of an image forming apparatus can be obtained by using a specific binder resin and adjusting the lightness and chromaticity of the toner in the powder state to fall within specific ranges.

The yellow toner (which may hereinafter be called "toner" simply) of the present invention has, when it is in the powder state, a lightness satisfying the relationship of L*>87 and has a chromaticity b* satisfying the relationship of 106<b*<120. The constitution of the image forming apparatus has of course a great influence on the toner. With regards to the influence on color, various reflection images (for example, glossy or matte ones, light or dark ones) are available, depending on the difference in fixing system such as fixing temperature, fixing pressure, fixing rate, hardness of the material of a fixing roller or the like, even when the same toner is used. In other words, the same fixed images cannot be obtained constantly even if the same toner is used, because it is influenced by external factors such as constitution of an apparatus used for image formation or environment. Accordingly, it is effective to evaluate the expressiveness of the color of a toner itself not from the fixed image of the toner but based on the measurement results of the toner itself.

One of the systems (color space) for digitizing the color is an L*a*b* color coordinate system. In this L*a*b* color coordinate system, color is represented by a lightness L* and chromaticities a* and b*, in which a* represents a chromaticities in the red direction, while b* represents a chromaticities in the yellow direction. Concerning a yellow toner, L* and b* are important factors. In the yellow toner, L* is a parameter participating in transparency, while b* is a parameter participating in coloring power. The yellow toner of the invention in the powder state falls within the following ranges: 87<L* and 106<b*<120. In this invention, a yellow toner having excellent transparency and coloring power is available by specifying L* and b* to fall within the above-described ranges. In order to bring about better effects in the invention, the lightness L* is preferably 88<L*, more preferably 90<L*, while the chromaticity b* is preferably 108<b*<120, more preferably 112<b*<120.

At 87≧L*, color miscibility when the plural colors are overlapped each other is inferior owing to poor transparency, resulting in a narrow color reproduction range. With an increase in b*, the coloring power heightens. When an attention is paid only to the reproduction of a yellow color on an image, a higher b* is preferred. But when b* is excessively high such as b*≧120, the amount of the yellow toner to be added becomes too small upon formation of a multicolor image, which destroys the mixing balance with toners of the other colors and may generate irregular color. For example, when a green color is expressed by mixing yellow and cyan, the yellow toner exists sparsely in a cyan toner when the amount of the yellow toner is too small relative to that of a cyan toner, presumably resulting in the generation of dots of cyan.

In consideration of color mixing and prevention of irregular color, it is therefore important to control L* and b* to satisfy the following ranges: 87<L* and 106<b*<120.

The yellow toner in the present invention is a toner used for the formation of a full color image using three colors of cyan, magenta and yellow or in addition black as the fourth color. It is also possible to use a toner of a color other than the above-described ones in combination.

To obtain a yellow toner satisfying 87<L* and 106<b*<120 in the powder state, a yellow colorant must be dispersed in the toner more finely and uniformly than the conventional ones.

A conventionally known method for producing a toner comprises: premixing a part of a binder resin with a colorant to prepare a colorant-dispersed resin having a high colorant concentration, that is, so-called "color masterbatch"; and mixing the color masterbatch thus obtained with the remaining part of the binder resin and the other components, thereby improving the dispersibility of the colorant in the toner. The color masterbatch is formed, for example, by flushing treatment, more specifically: by synthesizing a colorant, mixing the colorant (colorant paste), which contains water and has not been pulverized (not been dried), with a resin under heating, and pelletizing the resulting mixture into dry pellets; or by mixing the colorant in the powder state, water and a resin under heating and pelletizing the resulting mixture into dry pellets. This flushing treatment improves dispersibility of the colorant, but it also involves a problem, that is, acceleration of the growth of yellow colorant particles by the calorie applied upon formation of dry pellets after mixing with the resin under heating. In addition, application of an extra calorie in a kneading step for mixing the color master batch with a resin, charge controlling agent and releasing agent also accelerates the growth of the yellow colorant particles.

The yellow toner of the present invention can be produced, for example, by the following process.

Upon preparation of a color masterbatch, a resin and a colorant are mixed under heating in the presence of water, for example, by using a colorant in paste form or adding water and the colorant is dispersed in the resin. It is the common practice to vaporize water to obtain a dry color masterbatch. In the invention, however, the minimum necessary calorie is added and water is not completely vaporized. The color masterbatch having water left therein is then provided for the subsequent step (ordinarily, melt-kneading step). The growth of the colorant is suppressed by reducing the calorie given to the yellow colorant, making it possible to finely disperse the colorant in the toner particles.

The water content of the water-containing color masterbatch (hydrated color masterbatch) has a great influence on the quality of the toner. In the invention, the water content of the color masterbatch is preferably from 5 to 25% by mass, more preferably from 8 to 20% by mass. When the water content is reduced to less than 5% by mass, an extra calorie is given to the yellow colorant, which may result in undesirable particle growth. When the water content exceeds 25% by mass, on the other hand, the good dispersion of the colorant in the toner particles cannot be obtained because deposits appear on the wall surface of a kneader or particle cohesion occurs upon mixing of the raw materials of the toner, or the stability of pouring the raw materials into the kneader decreases, which tends to impair the color uniformity or charge uniformity.

In the present invention, a toner is preferably prepared by at least the following steps: a step of heating and mixing a colorant and a part of a binder resin in the presence of water and obtaining a hydrated color masterbatch having a water content of from 5 to 25% by mass; a melt-kneading step of melt-kneading at least the hydrated color masterbatch and the remaining binder resin to obtain a kneaded product; and a pulverizing step of pulverizing the kneaded product.

In the melt-kneading step of the hydrated color masterbatch and the other toner materials (binder resin, releasing agent, charge controlling agent, etc.), the kneading temperature Tmix (° C.) of resin preferably satisfies the following equation: Tmix≦Tm+20, in which Tm (° C.) means a softening point of the binder resin. By adjusting the kneaded resin temperature Tmix within the above-described range, an excess calorie is not given to the yellow colorant, whereby particle growth of the yellow colorant can be prevented. It is very difficult to control the kneading temperature Tmix of resin to satisfy the equation: Tmix≦Tm+20 when an ordinarily used dry color masterbatch is kneaded with the other toner materials. The temperature of the resin increases as kneading proceeds, which may result in Tmix>Tm +20. When the kneading temperature is excessively low, on the other hand, a too high resin viscosity disturbs kneading itself. When the color masterbatch having an adequate water content as described above is used, it becomes possible to control kneading at low temperatures by adjusting the kneading temperature or the screw speed and in addition, by utilizing the vaporization heat of water.

The term "kneading temperature (Tmix) of resin" as used herein means a resin temperature just after completion of the melt-kneading step and is determined by measuring the resin temperature just after discharged from the kneader.

When the softening point Tm (° C.) of the binder resin is too high, the resulting toner has poor fixing property, while when it is too low, the toner has poor storage stability. The softening point therefore preferably falls within the following range: 90≦Tm≦140, more preferably 95≦Tm≦130.

It has been found that upon kneading of the binder resin and colorant, or upon preparation of the color master batch when it constitutes the producing process, control of the particle diameter distribution of the colorant is more effective for preventing the growth of the particles of the colorant. It is preferred that in the invention, in the number-basis particle diameter distribution of the colorant when kneaded with the resin, a median diameter D is 100 nm or less, and the frequency $D_{150}$ of the particles having a particle diameter of 150 nm or more is 12% or less. The use of the colorant having such a particle diameter distribution can bring about a greater effect on the control of the particle growth of the colorant in the masterbatch preparing process or melt-kneading step of toner materials. To enhance the above-described effect of the invention, the median diameter D in the particle diameter distribution is preferably from 40 to 90 nm and the particle frequency $D_{150}$ is preferably 8% or less. At $D_{150}$>12%, a number of large particles exist and they may be nuclear particle for their growth, which inevitably results in the formation of large colorant particles. It is therefore preferred to use a colorant containing large-particle-diameter particles as less as possible. When the median diameter D exceeds 100 nm, the particle diameter of the colorant itself is too large and its transparency and coloring power become poor. The median diameter D less than 40 nm is, on the other hand, undesirable because the colorant may has poor weather resistance.

In the yellow toner thus prepared, the yellow colorant is finely and uniformly dispersed in the toner particles compared with the conventional toner. Although the toner acquires a coloring power as high as 106<b*, the amount of the yellow colorant in the toner can be reduced. Yellow colorants usually have a high chargeability compared with that of a colorant of another color so that it was impossible to set the development contrast of the yellow toner similar to that of another color toner and to carry out development using a developing bias common to them. Since sufficient coloring power can be attained even the content of the yellow colorant is reduced, it is possible to reduce the yellow colorant content of the yellow toner and suppress the influence of it on the charge as low as possible. This makes it possible to attain a substantially same development contrast as that of another color and as a result, a developing bias to be applied by a developing bias supply unit commonly used for these colors can be utilized, leading to simplification and miniaturization of the constitution of the image forming apparatus.

In order to control the charge property of the toner, control of the charge property of the binder resin which constitutes the most of the toner is important. Particularly, the binder resin is closely related to the charge response so that a binder resin containing a polyester unit exhibiting excellent charge response is effective. In consideration of the charge response and dispersibility of a releasing agent, the polyester-unit-containing binder resin to be used for the toner of the invention is preferably selected from (a) polyester resins, (b) hybrid resins in which a polyester unit and a vinyl copolymer unit have been chemical bonded, (c) mixtures of a hybrid resin and a vinyl copolymer, (d) mixtures of a polyester resin and a vinyl copolymer, (e) mixtures of a hybrid resin and a polyester resin, and (f) mixtures of a polyester resin, a hybrid resin and a vinyl copolymer.

The binder resin to be used in the invention has a main peak within a molecular weight range of from 3,500 to 30,000, more preferably from 5,000 to 20,000 in the molecular weight distribution of a soluble content in THF (tetrahydrofuran) as measured by gel permeation chromatography (GPC). A ratio Mw/Mn of the weight average molecular weight Mw to the number average molecular weight Mn is preferably 5.0 or greater.

When the main peak exists in a range less than 3,500, the hot-offset resistance of the toner tends to be insufficient. The main peak existing in a range exceeding 30,000, on the other hand, impairs adequate low-temperature fixing property and disturbs smooth application to high-speed fixing. When the Mw/Mn is less than 5.0, the toner is not able to have good offset resistance.

The term "polyester unit" as used herein means a portion derived from polyester, while the term "vinyl copolymer unit" means a portion derived from a vinyl copolymer. Examples of the polyester monomer constituting the polyester unit include polyvalent carboxylic acid components and polyhydric alcohol components.

When a polyester resin containing a polyester unit is used as the binder resin, a polyhydric alcohol, polyvalent carboxylic acid, carboxylic anhydride and carboxylate ester can be used as a raw material monomer. More specifically, examples of a dihydric alcohol component include alkylene oxide adducts of bisphenol A such as polyoxypropylene (2.2)-2,2-bis (4-hydroxyphenyl)propane, polyoxypropylene (3.3)-2,2-bis(4-hydroxyphenyl) propane, polyoxyethylene(2.0)-2,2-bis (4-hydroxyphenyl) propane, polyoxypropylene(2.0)-polyoxyethylene(2.0)-2,2-bis(4-hydroxyphenyl)propane and polyoxypropylene(6)-2,2-bis(4-hydroxyphenyl) propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

Examples of alcohols having three or more hydroxy groups include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of the acid component include aromatic dicarboxylic acids such as phthalic acid, isophthalic acid and terephthalic acid, and anhydrides thereof; alkyldicarboxylic acids such as succinic acid, adipic acid, sebacic acid and azelaic acid, and anhydrides thereof; succinic acid substituted with a $C_{6-12}$ alkyl group and anhydrides thereof; and unsaturated dicarboxylic acids such as fumaric acid, maleic acid and citraconic acid, and anhydrides thereof.

Of these polyester resins, those obtained by the polycondensation of a bisphenol derivative represented by the below-described formula (2) as a diol component and a carboxylic acid component composed of a polyvalent carboxylic acid or anhydride thereof or a lower alkyl ester thereof (such as fumaric acid, maleic acid, maleic anhydride, phthalic acid, terephthalic acid, trimellitic acid, or pyromellitic acid) as an acid component are preferred, because the color toner obtained using it has a good chargeability.

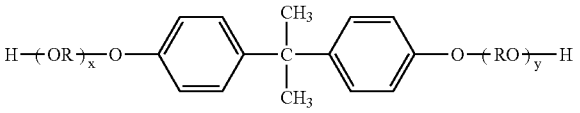

(wherein, R represents an ethylene or propylene group, x and y each independently stands for an integer of 1 or greater with the proviso that the average of x+y falls within a range of from 2 to 10.)

When a polyester resin is used as the binder resin in the present invention, the resin may have a crosslinked structure. Examples of the polycarboxylic acid component having at least three carboxyl groups, which component is for the formation of a polyester resin having a crosslinked site, include 1,2,4-benzenetricarboxylic acid, 1,2,5-benzenetricarboxylic acid, 1,2,4-naphthalenetricarboxylic acid, 2,5,7-naphthalenetricarboxylic acid and 1,2,4,5-benzenetetracarboxylic acid, and anhydrides and ester compounds thereof. The polycarboxylic acid component having at least three carboxyl groups is preferably used in an amount of from 0.1 to 1.9 mol % based on the whole monomers constituting the polyester resin.

When a hybrid resin having a polyester unit and a vinyl copolymer unit is used as the binder resin, it is expected to provide good wax dispersibility, and improved low-temperature fixing property and offset resistance. The term "hybrid resin" as used herein means a resin in which a vinyl copolymer unit and a polyester unit have been chemically bonded each other. More specifically, such a hybrid resin is formed by the transesterification between a polyester unit and a vinyl copolymer unit obtained by polymerizing a, carboxylate-ester-containing monomer such as (meth)acrylate ester. Such a hybrid resin may preferably assume a form of a graft copolymer (or a block copolymer) comprising the vinyl polymer unit as the trunk polymer and the polyester unit as a branch polymer. In the invention, the term "hybrid resin component" means a component constituting the above-described hybrid resin (a resin component having a structure in which a vinyl copolymer unit and a polyester unit have been chemically bonded).

Examples of vinyl monomers for the formation of a vinyl copolymer unit or vinyl copolymer include styrene; styrene derivatives such as o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; styrene derivatives with unsaturated monoolefins such as ethylene, propylene, butylene and isobutylene; unsaturated polylenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole, and N-vinylpyrrolidone; vinylnaphthalenes; and acrylic acid derivatives or methacrylic acid derivatives such as acrylonitrile, methacryronitrile and acrylamide.

In addition, examples include monomers containing carboxyl group, for example, unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride and alkenylsuccinic anhydride; half esters of an unsaturated dibasic acid such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; esters of an unsaturated dibasic acid such as dimethyl maleate and dimethyl fumarate; α,β-unsaturated acids such as acrylic acid, methacrylic acid, crotonic acid and cinnamic acid; α,β-unsaturated acid anhydrides such as crotonic anhydride and cinnamic anhydride; anhydrides between such an α,β-unsaturated acid and a lower aliphatic acid; and alkenylmalonic acid, alkenylglutaric acid and alkenyladipic acid, and anhydrides and monoesters of the acid.

Further, examples include hydroxyl-containing monomers, for example, acrylate or methacrylate esters such as 2-hydroxyethyl acrylate, 2-hydroxyethyl methacrylate and 2-hydroxypropyl methacrylate; 4-(1-hydroxy-1-methylbutyl) styrene, and 4-(1-hydroxy-1-methylhexyl)-styrene.

In the toner according to the present invention, the vinyl copolymer unit of the binder resin may have a structure crosslinked by a crosslinking agent having at least two vinyl groups. Examples of the crosslinking agent include aromatic divinyl compounds such as divinylbenzene and divinylnaphthalene; diacrylate compounds linked via an alkyl chain such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate for the acrylate of the above-described compounds; diacrylate compounds linked via an alkyl chain having an ether bond such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate for the acrylate of the above-described compounds; and diacrylate compounds linked via a chain having an aromatic group and an ether bond such as polyoxyethylene (2)-2,2-bis(4-hydroxyphenyl)propane diacrylate, polyoxyethylene(4)-2,2-bis(4-hydroxyphenyl)propane diacrylate and compounds obtained by substituting methacrylate for the acrylate of the above-mentioned compounds.

Examples of a polyfunctional crosslinking agent include pentaerythritol triacrylate, trimethylolethane triacrylate, trimethylolpropane triacrylate, tetramethylolmethane tetracrylate and oligoester acrylate, and compounds obtained by substituting methacrylate for the acrylate of the above-described compounds; and triallyl cyanurate and triallyl trimellitate.

Examples of the polymerization initiator to be used for the preparation of the vinyl polymer in the present invention include 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methylpropane); ketone peroxides such as methyl ethyl ketone peroxide, acetylacetone peroxide and cyclohexanone peroxide; 2,2-bis(t-butylperoxy) butane, t-butyl hydroperoxide, cumene hydroperoxide, 1,1,3,3-tetramethylbutyl hydroperoxide, di-tert-butyl peroxide, t-butyl cumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxycarbonate, di-methoxyisopropyl peroxydicarbonate, di(3-methyl-3-methoxybutyl)peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

As the acid component and alcohol component to be used upon synthesis of the polyester unit in the hybrid resin, the acid component and alcohol component used upon synthesis of the above-described polyester resin can be used.

Examples of a preparation process of the hybrid resin used for the toner of the present invention include the following processes (1) to (6).

(1) The hybrid resin can be synthesized by preparing a vinyl copolymer and a polyester resin separately, dissolving them in a small amount of an organic solvent to swell them, adding an esterifying catalyst and alcohol, and heating to cause a transesterification reaction.

(2) After preparation of a vinyl copolymer unit, a polyester unit and a hybrid resin component are prepared in the presence thereof. The hybrid resin component is prepared by the reaction between the vinyl copolymer unit (a vinyl monomer can be added as needed) and a polyester monomer (alcohol, carboxylic acid) and/or polyester. In this case, an organic solvent can be used as needed.

(3) After preparation of a polyester unit, a vinyl copolymer unit and a hybrid resin component are prepared in the presence thereof. The hybrid resin component is prepared by the reaction between the polyester unit (a polyester monomer can be added as needed) and a vinyl monomer and/or vinyl copolymer unit.

(4) After preparation of a vinyl copolymer unit and a polyester unit, a vinyl monomer and/or polyester monomer (alcohol, carboxylic acid) is added in the presence of these polymer units, whereby a hybrid resin component is prepared. Also in this case, an organic solvent can be used as needed.

(5) After preparation of a hybrid resin component, a vinyl monomer and/or polyester monomer (alcohol, carboxylic acid) is added to carry out addition polymerization and/or polycondensation reaction, whereby a vinyl copolymer unit and a polyester unit are prepared. In this case, as the hybrid resin component, that prepared in accordance with any one of the processes (2) to (4) can be used. A hybrid resin component prepared in a known manner can be used if necessary. In addition, an organic solvent can be used as needed.

(6) A vinyl copolymer unit, a polyester unit and a hybrid resin component are prepared by mixing a vinyl monomer and a polyester monomer (alcohol, carboxylic acid, etc.) and successively carrying out addition polymerization and polycondensation reaction. In addition, an organic solvent can be used as needed.

In the above-described preparation processes (1) to (5), as the vinyl copolymer unit and/or polyester unit, a plurality of polymer units different in molecular weight or crosslinking degree can be used.

The binder resin to be incorporated in the yellow toner of the present invention may be a mixture of the polyester resin and vinyl copolymer, a mixture of the hybrid resin and vinyl copolymer, a mixture of the polyester resin and hybrid resin, or a mixture of the polyester resin, hybrid resin and vinyl copolymer. The binder resin preferably contains the hybrid resin.

The binder resin contained in the toner of the present invention has preferably a glass transition point of from 40 to 90° C., more preferably from 45 to 85° C. The acid value of the resin is preferably from 1 to 40 mg KOH/g.

To the yellow toner of the present invention, a known charge controlling agent can be added. Examples of such a charge controlling agent include organometallic complexes, metal salts, and chelate compounds such as monoazo metal complexes, acetylacetone metal complexes, hydroxycarboxylic acid metal complexes, polycarboxylic acid metal complexes, and polyol metal complexes. Additional examples include carboxylic acid derivatives such as metal salts of a carboxylic acid, carboxylic anhydrides, and carboxylates; and condensates of an aromatic compound. In addition, bisphenols and phenol derivatives such calixarenes can be used. Of these charge controlling agents, metal compounds of an aromatic carboxylic acid are preferably used from the viewpoint of a satisfactory charge response.

In the present invention, the content of a charge controlling agent is preferably from 0.2 to 10 parts by mass, more preferably from 0.3 to 7 parts by mass, with respect to 100 parts by mass of the binder resin. The content less than 0.2 part by mass is not effective for attaining a satisfactory charge response, while that exceeding 10 parts by mass causes an excessively large environmental change.

The yellow toner of the present invention may contain releasing agents as described below. Examples include aliphatic hydrocarbon waxes such as low molecular weight polyethylene, low molecular weight polypropylene, olefin copolymer, microcrystalline wax, paraffin wax, and Fischer-Tropsch wax; oxides of an aliphatic hydrocarbon wax such as polyethylene oxide wax; block copolymers of an aliphatic hydrocarbon wax; waxes composed mainly of a fatty acid ester such as carnauba wax, behenyl behenate and montan acid ester wax; and waxes obtained by deoxidizing a part or whole of an aliphatic acid ester such as deoxized carnauba wax.

Additional examples include partially esterified products of a fatty acid and a polyhydric alcohol such as monoglyceride behenate and methyl ester compounds having a hydroxyl group available by hydrogenation of a vegetable oil or fat. Of these, aliphatic hydrocarbon waxes such as paraffin wax, polyethylene and Fischer-Tropsch wax having a short molecular chain, causing less steric hindrance and having excellent mobility are particularly preferred.

In the molecular weight distribution of the releasing agent, its main peak preferably exists within a molecular weight range of from 350 to 2,400, with a range of from 400 to 2,000 being more preferred. A releasing agent having a molecular weight distribution within the above-described range can give desirable thermal properties to the toner.

It is preferred that in an endothermic curve in the measurement by differential thermal analysis (DSC), the releasing agent to be used in the present invention has one or a plurality of endothermic peak(s) within a temperature range of from 30 to 200° C., and the maximum endothermic peak temperature Tsc of the endothermic peaks falls within the following range: 600C<Tsc<110° C., more preferably 70° C.<Tsc<90° C. When Tsc is not greater than 60° C., the toner may have poor anti-blocking properties. When Tsc is 110° C. or more, on the other hand, low temperature fixation cannot be attained sufficiently, which is undesirable from the viewpoint of energy saving.

The releasing agent to be used in the present invention is preferably added in an amount of from 1 to 10 parts by mass, more preferably from 2 to 8 parts by mass, with respect to 100 parts by mass of the binder resin. When the amount is less than 1 part by mass, much calorie and pressure must be applied to the toner in order that the releasing agent appears from the toner surface upon melting and exhibit sufficient releasability. When the amount exceeds 10 parts by mass, on the other hand, a too large content of the releasing agent in the toner may impair transparency or chargeability. Amounts outside the above-described range are therefore not preferred.

As described above, the binder resin, colorant and releasing agent differ greatly in their chargeability. It is therefore important to control the chargeability of the toner by controlling the chargeability of the binder resin which occupies the most portion of the toner. At the same time, it is effective to reduce the amount of the yellow colorant as much as possible to suppress the influence of the chargeability of the yellow colorant on the toner and conform the chargeability to that of a toner of another color. As a colorant of the yellow toner to be used in the invention, that having a monoazo group is preferred, because it has a high coloring power and has a small particle diameter owing to a relatively low molecular weight just after the synthesis of the pigment. Examples of the monoazo pigment include C.I. Pigment Yellow 1, 2, 3, 5, 6, 65, 73, 74, 75, 97, 98, 120, 151, 168, 169, 191 and 194. Of these, pigments having a structure represented by the below-described formula (3), for example, C.I. Pigment Yellow 74, 97 and 194 are preferred.

(3)

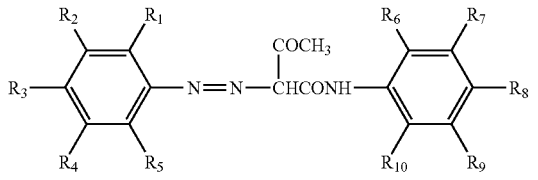

(wherein, at least one of $R_1$ to $R_5$ represents —$OCH_3$ and the remaining ones each represents a group selected from —H, —$NO_2$, —$CH_3$, —Cl, —$SO_3H$ and —$SO_2NHC_6H_5$, $R_6$ to $R_{10}$ each represents a group selected from —H, —$CH_3$, —$OCH_3$, $OC_2H_5$, —$NO_2$, —Cl and —$SO_3H$, with the proviso that $R_8$ and $R_9$ may form —NH—CO—NH—.

Of the colorants represented by the formula (3), particularly preferred is Pigment Yellow 74 having the following structure:

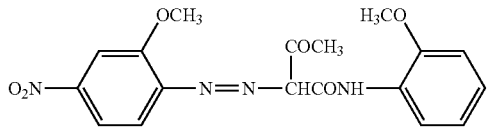

The colorant is used in an amount of from 1 to 10 parts by mass, preferably from 3 to 8 parts by mass, with respect to 100 parts by mass of the binder resin.

As described above, when a color masterbatch is mixed with the other toner materials upon producing the toner of the invention, the colorant as a starting material preferably has, in the number-basis particle diameter distribution, a median particle diameter of 100 nm or less (more preferably, from 40 to 90 nm) and a particle frequency $D_{150}$ of particles having a particle diameter of 150 nm or more within a range of 12% or less (more preferably, 8% or less) in the powder state or paste form.

As one process suited for the producing the yellow toner of the present invention having a lightness L* satisfying the relationship of L*>87 and a chromaticity b* satisfying the relationship of 106<b*<120 in the powder state, a process for producing the toner by using the above-described pigment (monoazo pigment) having a monoazo group as the colorant and carrying out a specific masterbatch forming step can be given. The masterbatch forming step here is a step of forming a hydrated masterbatch having a water content within a specific range (from 5 to 25% by mass, preferably from 8 to 20% by mass) by suppressing a calorie to be added to the material as much as possible to inhibit the growth of the particles of the colorant upon mixing the colorant with a part of the binder resin under heat to uniformly disperse the former in the latter.

The yellow toner of the present invention is produced in the following manner.

The yellow toner of the present invention can be produced preferably by a process comprising: a raw material mixing step of mixing raw materials of the toner (internal additives); a melt-kneading step of melt-kneading the resulting raw material mixture to disperse the colorant and the like to yield a colored resin composition; a cooling step of cooling the colored resin composition thus obtained; and a pulverizing step of pulverizing the cooled resin composition into a predetermined particle diameter.

In the raw material mixing step, predetermined amounts of at least the resin and the above-described hydrated color masterbatch are weighed as internal additives of the toner, followed by mixing. Examples of a mixing apparatus include double cone mixer, V-type mixer, drum mixer, super mixer, Henschel mixer, and Nauta mixer.

The raw materials of the toner mixed in the above-described mixing step are melt-kneaded to melt the resins and the colorant and the like are dispersed therein. In this melt-kneading step, a batch kneader such as pressure kneader or Banbury mixer, or a continuous kneader can be used. In recent years, a single screw or twin screw extruder has become popular owing to its advantage of permitting continuous production. For example, a KTK series twin screw extruder manufactured by Kobe Steel, Ltd., a TEM series twin screw extruder manufactured by Toshiba Machine Co., Ltd., a twin screw extruder manufactured by KCK Corporation, a co-kneader manufactured by Buss Co., Ltd, and the like are ordinarily used. Upon melt-kneading, it is preferred to adjust the kneaded resin temperature Tmix to not greater than [the softening point of the binder resin Tm+20° C.] in order to obtain a good dispersion of the colorant in the toner by suppressing the particle growth of the colorant. The colored resin composition available by melt-kneading the toner materials is rolled by a twin roll after melt-kneading, followed by cooling with water in the cooling step.

Next, the colored resin composition thus cooled in the above-described cooling step is usually pulverized into a desired particle diameter at the pulverizing step. In the pulverizing step, first, the colored resin composition is roughly pulverized by a crusher, hammer mill or feather mill, followed by further pulverization with Criptron System manufactured by Kawasaki Heavy Industries or Super Rotor manufactured by Nisshin Engineering. The pulverized product is then classified using a screen classifier, for example, a classifier such as "Elbow-Jet" (product of Nittetsu Mining Co., Ltd.) adopting an inertia classification system or "Turboplex" (product of Hosokawa Micron Corporation) adopting a centrifugal classification system, to obtain a classified product having a weight average particle diameter of from 3 to 11 μm. At this time, the classified product may be subjected to surface modification, that is, conglobating treatment in a surface modifying step, if necessary. Examples of the apparatus to be used for such surface modification include "Hybridization System" manufactured by Nara Machinery and "Mechanofusion System" manufactured by Hosokawa Micron. If necessary, a screen classifier such as HIBOLTA (a wind screen; product of Shin Tokyo Kikai) may be used.

To the pulverized or classified product thus obtained, that is, toner particles, a known external additive is added as needed, whereby the toner of the present invention is prepared. The external additive is externally added to the toner particles in the following manner. A predetermined amount of an external additive such as silica or titanium oxide is added to the pulverized or classified toner particles. The resulting mixture is then stirred and mixed by using, as an externally adding machine, a high-speed stirrer capable of giving a shear force to the particles, such as Henschel mixer or super mixer.

As the external additives to be mixed with the toner particles, conventionally known ones can be used. Although no particular limitation is imposed on them, a flowability improver can be preferably added in the invention. Any flowability improver can be used insofar as it enhances flowability of the toner particles compared with that before addition. Examples include fine fluororesin powder such as vinylidene fluoride and polytetrafluoroethylene, fine powder of titanium oxide, fine alumina powder, fine silica powder such as wet-process silica or dry-process silica, and these powders surface-treated with a silane coupling agent, titanium coupling agent or silicone oil.

The dry-process silica is a fine powder prepared by vapor-phase oxidation of a silicon halide compound, which is also called fumed silica. It is prepared by the conventionally known technology. Upon preparation, a thermal decomposition oxidation reaction in the oxyhydrogen flame of a silicon tetrachloride gas is utilized and this reaction essentially proceeds as shown in the following reaction formula:

$$SiCl_4+2H_2+O_2 \rightarrow SiO_2+4HCl$$

In this preparation process, it is possible to obtain a composite fine powder of silica and another metal oxide by using both a metal halide compound such as aluminum chloride or titanium chloride and the silicon halide compound. Such a composite fine powder is also embraced in the dry-process silica. The fine silica powder has preferably a particle diameter of from 0.001 to 2 μm, more preferably from 0.002 to 0.2 μm in terms of an average primary particle diameter. The silica fine powder having an average primary particle diameter of from 0.002 to 0.2 μm are particularly preferred.

It is more preferred to use a treated fine silica powder obtained by preparing a fine silica powder by vapor phase oxidation of the silicon halide compound and subjecting the resulting fine silica powder to hydrophobic treatment. Of the treated fine silica powder, that treated to have a methanol hydrophobicity to fall within a range of from 30 to 80 is especially preferred.

The fine silica powder is made hydrophobic by chemically treating it with an organosilicon compound which reacts with the fine silica powder or physically adsorbs thereto.

Examples of such an organosilicon compound include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethyl polysiloxane having 2 to 12 siloxane units in a molecule and having, in a unit positioned at each terminal, one hydroxyl group bonded to Si The above-described compounds may be used either singly or as a mixture of two or more of them. In the present invention, an amino-containing coupling agent or silicone oil can be used as the treating agent.

As a flowability improver to be used in the present invention, that having a BET specific surface area of 30 $m^2/g$ or more, preferably 50 $m^2/g$ or more as measured by nitrogen adsorption provides a satisfactory result. The flowability improver is added preferably in an amount of from 0.01 to 8 parts by mass, preferably from 0.1 to 4 parts by mass, with respect to the 100 parts by mass of the toner.

When the toner is used as a two-component developer, the toner is mixed with a magnetic carrier. Examples of the magnetic carrier include metal particles with the surface oxidized or unoxidized such as iron, lithium, calcium, magnesium, nickel, copper, zinc, cobalt, manganese, chromium, and rare-earth elements, and alloy particles or oxide particles thereof, and ferrite. The above-described magnetic carriers having a surface covered with a resin, which is called "coated carrier", are especially preferred in the development method of applying an AC bias to a developing sleeve. As the coating method, conventionally known methods are usable, for example, a method of dissolving or suspending a coating material such as resin in a solvent and then allowing the resulting coating solution to adhere onto the surface of magnetic carrier core particles; and a method of mixing magnetic carrier core particles with a coating material in the powder form.

Examples of the coating material with which the surface of the magnetic carrier core particles is covered include a silicone resin, a polyester resin, a styrene-based resin, an acrylic resin, polyamide, polyvinyl butyral, and an aminoacrylate resin. These resins may be used either singly or in combination. The particles are covered with 0.1 to 30% by mass (more preferably 0.5 to 20% by mass) of the coating material with respect to the amount of the carrier core particles. The carriers have an average particle diameter of preferably 10 to 100 μm, more preferably 20 to 70 μm.

When the toner of the present invention and a magnetic carrier are mixed to prepare a two-component developer, their mixing ratio adjusted to from 2 to 15% by mass, preferably from 4 to 13% by mass in terms of a toner concentration in the developer provides a satisfactory result. A toner concentration of less than 2% by mass tends to reduce the image density, while a toner concentration exceeding 15% by mass tends to cause fogging or scattering in a machine.

The above-described yellow toner can also be suited for non-magnetic one-component development.

The yellow toner of the invention can be used in an image forming apparatus such as a conventionally known electrophotographic apparatus. Although no particular limitation is imposed, the toner is preferably used in an image forming apparatus having at least: an image bearing member for bearing an electrostatic latent image; a charging unit for charging the image bearing member; a latent image forming unit for forming the electrostatic latent image on the image bearing member thus charged by the charging unit, and a developing unit for forming a toner image by developing the electrostatic latent image formed on the image bearing member; wherein the developing unit has a developing unit A for developing with the yellow toner, a developing unit B for developing with a toner other than the yellow toner, and a developing bias supplying unit for applying a developing bias at the time of development; and a developing bias upon development by the developing unit A and another developing bias upon development by the developing unit B are applied by a common developing bias supplying unit.

Since the yellow toner of the invention is a color toner, it can be used preferably in a full color image forming apparatus, together with magenta and cyan toners, and if necessary with a black toner in addition. As the full color image forming apparatus, a tandem type apparatus which has, for each color toner, a unit equipped with a latent image bearing member, a charging unit, a latent image forming unit and a developing unit, and forms the toner image of each color on the latent image bearing member of each color, and obtains a full-color image by transferring and superposing the images onto a transfer material successively and then fixing the image. Alternatively, an image forming apparatus may form a full color image by using a plurality of developing unit corresponding to the number of toners each used for one latent image bearing member, forming the toner image of each color on the latent image bearing member, transferring and superposing the toner images successively over an intermediate transfer member, and transferring the toner images on the intermediate transfer member to a transfer material. It is needless to say that the yellow toner of the invention can be used together with a toner of another color.

The yellow toner of the invention can be adjusted to have a chargeability equal to that of a toner of another color so that one developing bias can be used commonly for the developing unit of each color and the number of power sources necessary for development can be reduced. As described above, the developing unit of each color can perform development by the developing bias applied from a common developing bias supplying unit. This contributes to the simplification and miniaturization of the constitution of the image forming apparatus.

The yellow toner of the invention can also be suited for the use in an image forming apparatus having: an image bearing member for bearing an electrostatic latent image; a charging unit for charging the image bearing member; a latent image forming unit for forming the electrostatic latent image on the image bearing member charged by the charging unit; a developing unit for forming a yellow toner image by developing the electrostatic latent image formed on the image bearing member with the yellow toner; a transfer unit for transferring the yellow toner image to a transferring material; and a fixing unit which has a rotary heating member and a rotary pressure member to be contacted with the rotary heating member under pressure and fixes the yellow toner image onto the transfer material under heating and pressure, wherein in the fixing unit, the rotary pressure member is pressed against the rotary heating member at a line pressure of from 490 to 980 N/M through the transfer member. The yellow toner of the invention enables the formation of an image excellent in color reproducibility even if a light-pressure fixing unit is used so that it is suited for use in an image forming apparatus as described above using a fixing unit with a relatively low line pressure.

Measuring methods of various physical properties used in the invention will next be explained.

1) Measurement of Maximum Endothermic Peak of Releasing Agent and Toner

A differential scanning calorimeter (DSC measurement apparatus) such as "DSC-7" (product of Perkin-Elmer) or DSC2920 (product of TA Instrument Japan) is used to measure the maximum endothermic peak of a toner in accordance with ASTM D3418-82.

From 5 to 20 mg, preferably 10 mg of a measurement sample is precisely weighed and placed in an aluminum pan. An empty aluminum pan is used as a reference. Measurement is carried out under normal temperature and normal humidity conditions while controlling a temperature raising rate to 10° C./min and a measurement range to from 30 to 200° C. Upon measurement, a temperature curve is as described below. The highest peak from the base line in a region not lower than the endothermic peak at a glass transition point Tg of the binder resin during the temperature raising step II is regarded as the maximum endothermic peak of the toner. Temperature curve:

Temperature raising I (from 30 to 200° C., raising rate: 10° C./min).

Temperature lowering I (from 200 to 30° C., lowering rate: 10° C./min).

Temperature raising II (from 30 to 200° C., raising rate: 10° C/min).

2) Measurement of Molecular Weight of Releasing Agent

Apparatus: GPC-150C (Waters Co., Ltd.).

Column: GMH-HT 30 cm, dual column (product of Tosoh).

Temperature: 135° C.

Solvent: o-Dichlorobenzene (added with 0.1% by mass Ionol).

Flow rate: 1.0 ml/min.

Sample: 0.4 ml of 0.15% by mass of wax is injected.

The molecular weight is measured under the above-described conditions. In calculation of the molecular weight of the wax, a molecular weight calibration curve drawn based on the mono-disperse polystyrene standard sample is used. Furthermore, the molecular weight of the releasing agent is calculated by polyethylene conversion in accordance with a conversion equation derived from Mark-Houwink viscosity formula.

3) Measurement of Molecular Weight Distribution of Toner and Binder Resin by GPC As described below, the molecular weight distribution of each of the toner and the resin component of the binder resin by GPC is determined by GPC while using a THF soluble content obtained by dissolving the toner or binder resin in a THF solvent.

Described specifically, the toner is added to THF, and the mixture is allowed to stand for several hours. After the mixture is sufficiently shaken to mix the toner and THF well (until a coalesced product of the sample disappears), the mixture is allowed to stand for additional 12 or more hours. At this time, the total time during which the sample is allowed to stand in THF is adjusted to at least 24 hours. The mixture is then passed through a sample treatment filter (having a pore size of from 0.45 to 0.5 μm, for example, "Maeshoridisk H-25-5" product of Tosoh Corporation or "Ekicrodisk 25CR"; product of Gelman Science Japan) to prepare a sample for GPC measurement. The sample is adjusted to give a resin component concentration of from 0.5 to 5 mg/ml.

The sample thus prepared by the above-described method is subjected to the GPC measurement in the following manner. A column is stabilized in a heat chamber of 40° C. Tetrahydrofuran (THF), as a solvent, is caused to flow in the column at a flow rate of 1 ml/min. About 50 to 200 μl of the sample is injected for measurement. Upon measurement of the molecular weight of this sample, the molecular weight distribution of the sample is calculated from the relationship between the counted number (retention time) and a logarithmic value of a calibration curve drawn from several types of mono-disperse polystyrene standard samples. As a standard polystyrene sample for drawing the calibration curve, for example, a sample manufactured by Tosoh Corp. or Pressure Chemical Co. and having a molecular weight of each of $6\times10^2$, $2.1\times10^3$, $4\times10^4$, $1.75\times10^4$, $5.1\times10^4$, $1.1\times10^4$, $3.9\times10^5$, $8.6\times10^5$, $2\times10^6$ and $4.48\times10^6$ is used. Use of at least about ten standard polystyrene samples is appropriate. As a detector, an RI (refractive index) detector is used.

For precise measurement of the molecular weight range of from $1\times10^3$ to $2\times10^6$, use of a plurality of commercially available polystyrene gel columns in combination is preferred. Examples include a combination of Shodex GPC KF-801, 802, 803, 804, 805, 806 and 807 (each product of Showa Denko) and a combination of p-styragel 500, $10^3$, $10^4$ and $10^5$ (each, product of Waters Co., Ltd.).

4) Measurement of Particle Diameter Distribution of Toner

In the present invention, the average particle diameter and particle diameter distribution of the toner are measured using "Coulter counter TA-II type" (product of Coulter Co., Ltd.), but "Coulter multisizer" (product of Coulter Co., Ltd.) may be used instead. As an electrolytic solution, a 1% aqueous NaCl solution prepared using first-class sodium chloride is used. For example, "ISOTON R-II" (product of Coulter Scientific Japan Co., Ltd.) can be used as such an electrolytic solution. Upon measurement, to 100 to 150 ml of the electrolytic aqueous solution, 0.1 to 0.5 ml of a surfactant, preferably alkyl benzene sulfonate, is added as a dispersing agent, followed by the addition of from 2 to 20 mg of the measurement sample. The electrolytic solution having the sample suspended therein is subjected to dispersing treatment by an ultrasonic dispersing device for about 1 to 3 minutes. By the measurement apparatus with a 100 μm aperture as an aperture, the volume and number of the toner particles having a particle diameter of 2.00 μm or more were measured, and a volume distribution and number distribution were calculated. Subsequently, a weight-average particle diameter (D4) is determined from the volume distribution according to the invention (a medium value of each channel is regarded as a representative value for each channel).

As the channel, 13 channels of 2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm are used.

5) Measurement of L* and b* in the Powder State

The L* and b* of the yellow toner in the powder state are measured using a spectrophotometer "SE-2000" (product of Nippon Denshoku Industries Co., Ltd.) according to JIS Z-8722, while using C-light source as a light source and setting the visual angle at 2°. Their measurement is carried out following the instructions attached to the apparatus, but a standard plate is preferably standardized by using a glass 2 mm thick and 30 mm in diameter in an optional measurement cell for powder. More specifically, the measurement is performed while placing the cell filled with the sample powder on a powder sample holder (attachment) of the above-described spectrophotometer. Prior to placing the cell on the powder sample holder, the powder sample is filled in the cell in an amount of at least 80% of the internal volume of the cell and is vibrated at once/sec on a vibration stand for 30 seconds. Then, the L* and b* are measured.

6) Measuring Method of Softening Point of Resin

Softening point is determined in accordance with JIS K-7210 using a Koka-type flow tester. A measuring method will next be described more specifically. Using a Koka type flow tester (product of Shimadzu Corporation), through a nozzle of 1 mm in diameter and 1 mm long, 1 $cm^3$ of a sample is extruded under a load of 1,960 $N/m^2$ (20 $kg/cm^2$) by a plunger, while heating it at a temperature raising rate of 6° C./minute. A curve of dropping amount of the plunger (flow value)-temperature is drawn. Supposing that the height of this S-shaped curve is h, a temperature corresponding to h/2 (meaning the temperature at which half of the resin is flown out) is defined as the softening point Tm of the resin.

7) Measuring Method of Particle Diameter of Colorant

A pigment and a nonionic surfactant are sandwiched at a ratio of 4:6 between glass plates (Hoover type Auto Muller) and mixed to disperse the former in the latter (JIS K 5101) The resulting mixed dispersion of the pigment and the surfactant is diluted with water in order that the pigment concentration in the mixed dispersion will be 5% by mass, followed by ultrasonic mixing for 5 minutes. The median diameter and particle diameter distribution (based on the number) of the mixture are measured using Dynamic Light Scattering Nanoparticle Size Analyzer ("LB-500", product of HORIBA, Ltd.). When the particle diameter of a paste pigment is measured, the pigment is subjected to vacuum deaeration at 60° C. while applying heat as less as possible and the resulting dried pigment is provided for the measurement.

The present invention will hereinafter be described in further detail by Examples. It should however be borne in mind that the present invention is not limited to or by them.

Production Example for Hybrid Resin

As monomers for forming a vinyl copolymer unit, 2.0 mols of styrene, 0.21 mol of 1,2-ethylhexyl acrylate, 0.14 mol of fumaric acid, 0.03 mol of a dimer of α-methylstyrene and 0.05 mol of dicumyl peroxide were charged in a dropping funnel. Also, as monomers for forming a polyester resin unit, 7.0 mols of polyoxypropylene (2.2)-2,2-bis(4-hydroxyphenyl)propane, 3.0 mols of polyoxyethylene (2.2)-2,2-bis(4-hydroxyphenyl)propane, 3.0 mols of terephthalic acid, 1.9 mols of trimellitic anhydride, 5.0 mols of fumaric acid and 0.2 g of dibutyltin oxide were put into a 4-liter four-necked flask made of glass, and a thermometer, a stirring rod, a condenser and a nitrogen inlet tube were attached thereto. The resulting flask was placed in a mantle heater. The flask was then purged with a nitrogen gas, followed by gradual heating with stirring. While stirring at 145° C., a vinyl monomer and a polymerization initiator were added dropwise to the reaction mixture in the flask from the dropping funnel over 4 hours. The mixture was heated to 200° C. and reacted for 4 hours to obtain a hybrid resin (Tm=110° C.). Its molecular weight was measured by GPC and the results are shown in Table 1.

Production Example for Polyester Resin 3.6 mols of polypropylene (2.2)-2,2-bis(4-hydroxyphenyl) propane, 1.6 mols of polyoxyethylene (2.2)-2,2-bis(4-hydroxyphenyl)propane, 1.7 mols of terephthalic acid, 1.4 mols of trimellitic anhydride, 2.4 mols of fumaric acid and 0.12 g of dibutyltin oxide are put into a 4-liter four-necked flask made of glass were charged. A thermometer, a stirring rod, a condenser and a nitrogen inlet tube were attached to the flask and it was placed in a mantle heater. Under a nitrogen atmosphere, the mixture was reacted at 215° C. for 5 hours, whereby a polyester resin (Tm=105° C.) was obtained. The molecular weight of the resin was measured by GPC and its results are shown in Table 1.

Production Example for Styrene-Acrylic Resin

| | |
|---|---|
| Styrene: | 70 parts by mass |
| n-Butyl acrylate: | 24 parts by mass |
| Monobutyl maleate: | 6 parts by mass |
| di-t-Butyl peroxide: | 1 part by weight |

While stirring 200 parts by mass of xylene in a four-necked flask, the flask was purged sufficiently with nitrogen. After heating to 120° C., the above-described components were added dropwise over 3.5 hours. Under a reflux flow of xylene, polymerization was completed. The solvent was distilled off under reduced pressure, whereby a styrene-acrylic resin (Tm=105° C.) was obtained. The molecular weight of the resulting resin was measured by GPC and its results are shown in Table 1.

TABLE 1

| | Molecular weight measured by GPC | | | |
|---|---|---|---|---|
| | Mw ($\times 10^3$) | Mn ($\times 10^3$) | Mp ($\times 10^3$) | Mw/Mn |
| Hybrid resin | 82.0 | 3.2 | 15.5 | 25.6 |
| Polyester resin | 26.5 | 3.5 | 7.5 | 7.6 |
| Styrene-acrylic resin | 80.4 | 6.7 | 10.0 | 12.0 |

EXAMPLE 1

A hydrated yellow masterbatch was prepared by using 70 parts by mass of the hybrid resin and 100 parts by mass of a paste pigment with a solid content of 30% by mass (the remaining 70% by mass: water) which pigment had been obtained by removing a certain amount of water from a pigment slurry containing P.Y. (Pigment Yellow) 74 and was not subjected to any drying step after synthesis (first kneading step).

The above-described materials were charged in a kneader type mixer, and were heated without pressure while mixing. At the time when the resulting mixture reached a maximum temperature (which was determined necessarily by the boiling point of a solvent in the paste; in this case, from about 80 to 100° C.), the pigment in aqueous phase (pigment slurry) was distributed or transferred to the molten resin phase. After confirmation of it, the mixture was further melt-kneaded for 15 minutes under heating at 90 to 100° C. to transfer the pigment in the paste sufficiently to the molten resin phase. After the mixer was stopped temporarily and the hot water was discharged, the residue was mixed for 10 minutes without heating to distill off water. The residue was cooled and then, pulverized into about 1 mm by pin mill pulverization, whereby a hydrated yellow masterbatch was obtained. The resulting hydrated yellow masterbatch had a water content of 15% by mass, a pigment content of 30% by mass and a resin content of 55% by mass.

Next, the below-described components were premixed fully in a Henschel mixer, followed by melt-kneading (second kneading) in a twin screw kneader so that the kneaded resin temperature just after discharged from a kneader became 120° C. (=Tm+10° C.).

| | |
|---|---|
| The hybrid resin (Tm = 110° C.): | 86.25 parts by mass |
| Purified normal paraffin (maximum endothermic peak temperature: 78° C.): | 4 parts by mass |
| Aluminum 3,5-di-t-butylsalicylate compound: | 2 parts by mass |
| The above-described hydrated yellow masterbatch (pigment content of 30% by mass): | 25 parts by mass |

The kneaded product thus obtained was cooled and then, roughly pulverized into particles having a particle diameter of about 1 to 2 mm by a hammer mill, followed by fine pulverization into particles having a particle diameter not greater than 20 μm by a pulverizing mill adopting an air jet system. From the finely pulverized product thus obtained, yellow toner particles 1 (classified product) were obtained using a classifier (Elbow-jet classifier). The charge response of the classified product thus obtained was evaluated in the following manner.

[Measurement of Charge Response of Classified Product]

After 3.5 g of the classified product and 46.5 g of magnetic ferrite carrier particles (Mn—Mg ferrite: average particle diameter of 45 μm) surface-coated with a silicone resin were weighed, they were put into a 50-ml plastic bottle. The bottle was allowed to stand under normal temperature and low humidity environment (23° C./5%) for at least 18 hours. After that, two bottle samples were prepared: one was shaken for 2 minutes and the other one was shaken for 30 minutes, each by a Yayoi shaker (model: YS-LD) at 200 rpm. At this time, the angle at which the bottles were shaken was set as follows. A direction right above the shaker (vertical direction) was set to 0°, and a shaking support was moved forward by 15° and backward by 20°. Then, the plastic bottles were each fixed to a fixing holder (prepared by fixing the cap of the sample bottle onto an extension line of the center of the support) attached to the tip of the support of the shaker. The triboelectric charge of each sample thus prepared was measured by a triboelectric charge analyzer shown if FIG. 1 in a similar manner to that employed for the measurement of the triboelectric charge of a toner, which will be described later and the charge response was calculated in accordance with the following equation:

Charge response (%)={(triboelectric charge of sample shaken for 2 minutes) /(triboelectric charge of sample shaken for 30 minutes))}×100

The charge response % thus determined was evaluated in accordance with the following standards:

A: 75% or more
B: 65% or more but less than 75%
C: 55% or more but less than 65%
D: 40% or more but less than 55%
E: less than 40%

Evaluation results are shown in Table 3. It has been found that the charge response of the yellow toner particles 1 was satisfactory.

To 100 parts by mass of the yellow toner particles 1, 1.2 parts by weight of acicular titanium oxide fine powders ("MT-100T"; product of Tayca, BET=62 $m^2/g$, treated with 10% by mass of isobutyltrimethoxysilane) were externally added using Henschel Mixer to produce a yellow toner 1. The yellow toner 1 had a weight average particle diameter of 7.0 μm. The L* and b* of the yellow toner 1 were measured in the powder state.

Furthermore, the yellow toner 1 and magnetic ferrite carrier particles surface-coated with silicone resin (Mn—Mg ferrite; having a volume average particle diameter of 45 μm) were mixed to give a toner concentration of 7.0% by mass, whereby a two-component developer 1 was obtained.

The resulting two-component developer 1 was subjected to a printing durability test. Described specifically, the developer was filled in a color copying machine "CLC-1000" (product of Canon), which had been remodeled by removing an oil application mechanism from its fixing unit, and an original manuscript having an image area ratio of 5% was printed on 10,000 sheets in a monochrome mode under a normal-temperature and low-humidity environment (N/L environment, 23° C./5% RH). A change in the charge amount before and after the printing durability test, and filming and fogging upon completion of the printing durability test were evaluated in the below-described manners. In addition, OHP transparency and irregular color were evaluated in the below-described manners.

[Filming]

After printing durability test on 10,000 sheets under normal-temperature low-humidity environment (23° C./5% RH), five copies of a yellow solid image (density: about 1.6) were made onto the whole A3 paper continuously. The number of white striped patterns was counted. An average number per A3 paper was calculated and filming was evaluated based on the following evaluation criteria:

A: no striped pattern
B: 1 striped pattern
C: more than 1 but within 3
D: more than 3 but within 5
E: more than 5

[Change in Triboelectric Charge]

FIG. 1 is a schematic view of an apparatus for measuring a triboelectric charge. About 0.5 to 1.5 g of a two-component developer collected from a developing sleeve of a copying machine or a printer was charged in a metal-made measuring vessel 52 having, at the bottom thereof, a 500-mesh (25 μm opening) screen 53, and the vessel was covered with a metallic lid 54. The weight of the whole measuring vessel 52 at this time was measured and denoted by W1. The vessel was placed on a suction unit 51 (at least a portion of this suction unit brought into contact with the measuring vessel 52 is an insulator). The developer was sucked through a suction hole 57 while an air quantity control valve 56 was adjusted so that the pressure of a vacuum gauge 55 became 4 kPa. Under such a state, suction was performed for an adequate time, preferably for 2 minutes, whereby the two-component developer was removed by suction. The potential of a potentiometer 59 at this time was denoted by V. Indicated at numeral 58 in the drawing is a condenser with a capacity of C. Furthermore, the weight of the whole measuring vessel after the suction was measured and denoted by W2. The triboelectric charge (mC/kg) of this sample was calculated from the following equation.

Triboelectric charge of sample (mC/kg) $=C\times V/(W1-W2)$ (with the proviso that measurement is conducted under the conditions of 23° C. and 60% RH).

Measurement was conducted twice in the above-described manner, that is, upon starting and after completion of the 10,000-sheet printing durability test. A change in the charge before and after the test was found and the sample was evaluated in accordance with the following evaluation criteria:

A: Less than 2 mC/kg
B: 2 mC/kg or more and less than 4 mC/kg
C: 4 mC/kg or more and less than 6 mC/kg
D: 6 mC/kg or more and less than 8 mC/kg
E: 8 mC/kg or more

[Fogging]

After the completion of the printing durability test, fogging was evaluated. Fogging was measured as follows. For a yellow image, an average reflectivity Dr (%) of plain paper before image output was measured with a reflectometer ("REFLECTOMETER MODEL TC-6DS", product of Tokyo Denshoku) equipped with a blue filter. On the other hand, a solid white image was output on a plain paper and a reflectivity Ds (%) of the solid white image was measured. Fogging (%) was calculated from the below-described equation and evaluated in accordance with the below-described evaluation criteria.

Fog(%)$=Dr-Ds$

A: Less than 0.7%
B: 0.7 or more and less than 1.2%
C: 1.2 or more and less than 1.5%
D: 1.5 or more and less than 2.0%
E: 2.0% or greater

[OHP Transmission]

An unfixed image of a yellow solid image was formed on half of an A4-size OHP sheet by using a color copying machine "CLC-1000" (product of Canon) and fixed by a fixing machine ("iRC3200", product of Canon) while adjusting the line pressure to 784 N/m. An image was formed by adjusting the development contrast so that the yellow solid portion of the image fixed to OHP has an image density satisfying the following equation:

$$D(\text{on solid paper})-D(\text{on REF paper})=1.6$$

in which,

D (on solid paper): a reflection density of the yellow solid image portion measured by laying the OHP sheet over plain paper, and D (on REF paper): a reflection density of a solid white portion (non image portion) measured by laying the OHP sheet over plain paper.

"X-rite 504" was used for measuring the reflection density, whereby a yellow density was measured.

The OHP transmission was calculated in accordance with the below-described equation by using the above-described yellow OHP image.

$$OHP\ \text{transmission}(\%)=\{D(\text{yellow solid})/D(REF)\}\times 100$$

in which,

D (yellow solid): a reflection density measured as the black density in the yellow solid image portion by laying the OHP sheet over the black portion of a correcting plate of "X-rite 404"; and D (REF): a reflection density measured as the black density in the solid white portion (non-image portion) by laying the OHP sheet over the black portion of a correcting plate of "X-rite 404".

"X-rite 504" was used for the measurement of the reflection density. The OHP transmission thus obtained was evaluated in accordance with the below-described evaluation criteria. This evaluation utilizes a phenomenon that a black density of the black portion of the correcting plate looks high when the transmission of the yellow solid image is high, while the black density of the black portion of the correcting plate looks low when the transmission of the yellow solid image is low.

A: 90% or more
B: 80% or more and less than 90%
C: 70% or more and less than 80%
D: 50% or more and less than 70%
E: less than 50%

[Irregular Color]

On A4 paper, a composite image of a yellow image and a cyan image was formed using a color copying machine "CLC-1000" (product of Canon). For the formation of the cyan image, employed was a cyan toner for comparison used for the measurement of a difference in the development contrast which will be described later. An unfixed image was formed by superimposing 0.3 mg/cm$^2$ portions of the respective color toners, followed by fixation by a fixing machine "iRC3200" (product of Canon) while adjusting a line pressure of the rotary pressure member to 784 N/m against to the rotary heating member. A green image thus formed by fixation was evaluated in accordance with the following criteria:

A: excellent with a uniform green color.
B: good because the color of cyan is hardly observed.
C: gradation of cyan and green is observed partially.
D: gradation of cyan and green is observed wholly.
E: apparent gradation of cyan and green is observed wholly.

[Measurement of Difference in Development Contrast Between Yellow Toner and Cyan Toner]

A cyan toner to be compared was prepared in the following manner. A hydrated color masterbatch was prepared using 70 parts by mass of a hybrid resin and 100 parts by mass of a paste pigment having a solid content of 30% by mass (the remaining 70% by mass is water) obtained by not performing a drying step at all, but by partially removing water from a pigment slurry containing and 30 parts by mass of P.B. (pigment blue) 15:3.

The above-described raw material was charged in a kneader type mixer and heated while mixing without applying pressure. After confirmation of the distribution or transfer of the pigment in the aqueous phase into a molten resin phase when the temperature of the mixture reached about 80 to 100° C., melt-kneading was further continued under heat of 90 to 100° C. for 15 minutes to completely transfer the pigment in the paste into the molten resin phase. Then, the mixer was stopped temporally and hot water was discharged. Remaining water was removed by mixing under heat at 120° C. for 15 minutes, followed by pulverization by pin mill pulverization into particles of about 1 mm, whereby a dry cyan masterbatch (water content: 0.7% by mass) was obtained.

| | |
|---|---|
| Hybrid resin | 86 parts by mass |
| Purified normal paraffin (maximum endothermic peak temperature: 78° C.) | 4 parts by mass |
| Aluminum 3,5-di-t-butylsalicylate compound | 2 parts by mass |
| Dry cyan masterbatch (pigment content: 30% by mass) | 30 parts by mass |

In a similar manner to that employed for the producing method of Yellow Toner 1 except for the use of the above-described components, a cyan toner was obtained.

A two-component developer containing a yellow toner was allowed to stand for at least 18 hours under normal temperature and normal humidity environment (23° C./5% RH). An unfixed image of a yellow solid image was formed on half of A4 size plain paper, followed by fixation using a fixing machine "iRC3200" (product of Canon). The development contrast was adjusted so that the reflection density of the yellow solid portion became 1.6. The development contrast applied on forming the yellow solid image at this time was denoted by "V (yellow)". A two-component developer containing cyan was obtained similarly by mixing with a carrier and a cyan solid image whose development contrast had been adjusted was formed. The development contrast applied on forming the cyan solid image at this time was denoted by "V (cyan)". A difference in the development contrast (V) was calculated in accordance with {V (yellow)−V (cyan)} and evaluated in accordance with the following criteria:

A: less than 10V
B: 10V or more and less than 20V
C: 20V or more and less than 30V
D: 30V or more and less than 40V
E: 40V or more Evaluation results are shown in Table 3. As shown in Table 3, L* and b* of the toner in the powder state are both high and the OHP transmission was excellent. In addition, the toner was free from irregular color and the development contrast in the initial stage was almost equal to that of the cyan toner, and therefore good. Even after printing durability test on 10,000 sheets, charge variations were small compared with the starting time of printing, and a yellow image which reproduces the original manuscript accurately without filming or fogging was obtained.

EXAMPLE 2

Yellow Toner 2 was obtained in the same manner as in Example 1 except that the components used in the second kneading step was changed as described below. As in Example 1, a two-component developer was prepared by mixing the resulting Yellow Toner 2 and a carrier and was evaluated for various properties. The results were satisfactory as shown in Table 3, though the developer is relatively inferior with regard to irregular color.

| | |
|---|---|
| Hybrid resin | 83.5 parts by mass |
| Purified normal paraffin (Maximum endothermic peak temperature: 78° C.) | 4 parts by mass |
| Aluminum 3,5-di-t-butylsalicylate compound | 2 parts by mass |
| Hydrated yellow masterbatch (pigment content: 30% by mass) | 30 parts by mass |

EXAMPLE 3

Yellow Toner 3 was produced in the same manner as in Example 1 except that the first kneading step was changed as described below.

In a kneader type mixer, 55 parts by mass of a hybrid resin, 30 parts by mass of P.Y. 74 in the powder state and 20 parts by mass of distilled water were charged. Under mixing, the mixture was heated without applying pressure thereto. As in Example 1, a hydrated yellow masterbatch was prepared. The resulting hydrated yellow masterbatch was found to have a water content of 15% by mass, a pigment content of 30% by mass and a resin content of 55% by mass.

Yellow Toner 3 was obtained in the same manner as in Example 1 except for the use of the above-described hydrated yellow masterbatch. The toner was valuated for various properties as in Example 1. The results were satisfactory as shown in Table 3 though the OHP transmission was a little inferior.

EXAMPLE 4

In the same manner as in Example 3 except that as shown in Table 2, a polyester resin was used instead of the hybrid resin in the first kneading step; 56.25 parts by mass of a polyester resin and 30 parts by mass of a styrene-acrylic resin were used instead of the hybrid resin in the second kneading step; the pigment was replaced with another one different in particle diameter; and the kneading temperature of resin was changed to Tm+20° C., Yellow Toner 4 was obtained. Various properties of it were evaluated as in Example 1. The results were satisfactory as shown in Table 3, though the OHP transmission was inferior.

EXAMPLE 5

In the substantially same manner as in Example 4, except that Pigment Yellow 73 having the below-described structure was used instead as a colorant, Yellow Toner 5 was obtained. Various properties of it were evaluated as in Example 1. The results were satisfactory as shown in Table 3, though the OHP transmission was inferior.

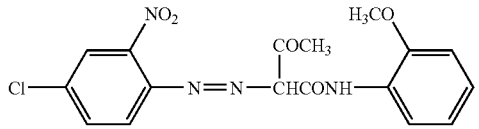

COMPARATIVE EXAMPLE 1

As shown in Table 2, a dry masterbatch was prepared in the following manner by using a dry pigment without using water in the first kneading step. 70 parts by mass of a hybrid resin and 30 parts by mass of P.Y. 73 in the powder state were put into a kneader type mixer. The resulting mixture was mixed while heating without applying a pressure thereto, followed by melt-kneading under heating at 90 to 110° C. for 30 minutes to transfer the pigment sufficiently. The kneaded product thus obtained was cooled, and pulverized by pin mill pulverization into particles of about 1 mm, whereby a dry yellow masterbatch was obtained. In the substantially same manner as in Example 5 except for the use of the dry yellow masterbatch thus obtained and change of the kneading temperature of resin to Tm+40° C., Yellow Toner 6 was obtained. Various properties of the resulting Yellow Toner 6 were evaluated. As a result, it was remarkably poor in the OHP transmission and difference in the development contrast as shown in Table 3.

COMPARATIVE EXAMPLE 2

In the substantially same manner to Example 5 except that, as shown in Table 2, the polyester resin was replaced with a styrene-acrylic resin in the first kneading step and the mixed resin was replaced with a styrene-acrylic resin in the second kneading step, Yellow Toner 7 was obtained. Various properties of the resulting Yellow Toner 7 were evaluated as in Example 1. As a result, charge response (%) of the classified product, variations in charge before and after printing durability test and fogging were remarkably inferior. the second kneading step in accordance with the below-described components. The kneading temperature of resin at this time was set to Tm+20° C.

| | |
|---|---|
| Polyester resin | 70 parts by mass |
| Styrene-acrylic resin | 30 parts by mass |
| Purified normal paraffin (maximum endothermic peak temperature: 78° C.) | 4 parts by mass |
| Aluminum 3,5-di-t-butylsalicylate compound | 2 parts by mass |
| Paste pigment of P.Y. 73 (solid content: 30% by mass) | 25 parts by mass |

The resulting Yellow Toner 10 had irregular color when visually observed, which was presumed to owe to inferior dispersion of the colorant. The irregular color was so marked as could be observed visually, so that evaluations of the other properties was not carried out.

COMPARATIVE EXAMPLE 6

In the substantially same manner as in Comparative Example 1 except that as shown in Table 2, 3 parts by mass of dehydroabiethylamine was added as an additive in the first kneading step, Yellow Toner 11 was obtained. Various properties of the resulting Yellow

COMPARATIVE EXAMPLE 3

In the substantially same manner as in Example 5 except that the pigment was replaced with another pigment different in particle diameter as shown in Table 2, Yellow Toner 8 was obtained. Various properties of the resulting Yellow Toner 8 were evaluated. As a result, the OHP transmission was inferior as shown in Table 3.

COMPARATIVE EXAMPLE 4

In the substantially same manner as in Example 5 except that as shown in Table 2, a dry masterbatch was prepared using a dry pigment without using water and 10 parts by mass of water was added in the second kneading step, Yellow Toner 9 was obtained. The dry masterbatch used here was same as that obtained in Comparative Example 1. Various properties of the resulting Yellow Toner 9 were evaluated. As a result, the OHP transmission and difference in the development contrast were inferior as shown in Table 3.

COMPARATIVE EXAMPLE 5

As shown in Table 2, Yellow Toner 10 was produced while omitting the first kneading step and performing Toner 11 were evaluated as in Example 1. As a result, filming, charge response of classified product, change in charge after durability test and fogging were much inferior as shown in Table 3.

COMPARATIVE EXAMPLE 7

In the substantially same manner as in Example 5 except that the pigment was replaced with Pigment Yellow 174 having a structure as described below, Yellow Toner 12 was obtained. Various properties of it were evaluated as in Example 1, resulting in poor OHP transmission and difference in development contrast as shown in Table 3.

TABLE 2

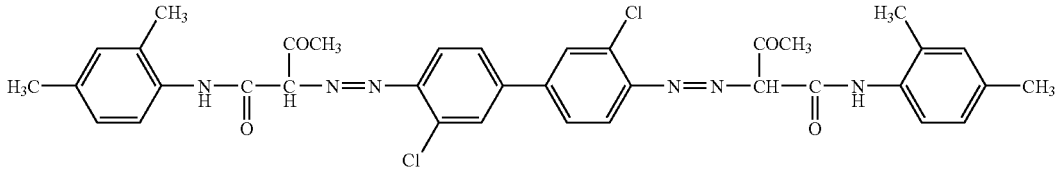

| | | Pigment | | | | | Preparation conditions | | |
|---|---|---|---|---|---|---|---|---|---|
| | | | Particle diameter upon preparation of masterbatch | | | | | | |
| | Binder resin | Kind | Median diameter (nm) | Proportion of particles with particle diameter of 150 nm or more (% by number) | Additive | Form of pigment upon preparation of masterbatch | Type of masterbatch | Kneaded resin temperature (° C.) |
| Toner 1 | Hybrid resin | P.Y. 74 | 75 | 6 | — | Paste pigment | Hydrated masterbatch | Tm + 10 |
| Toner 2 | Hybrid resin | P.Y. 74 | 75 | 6 | — | Paste pigment | Hydrated masterbatch | Tm + 10 |
| Toner 3 | Hybrid resin | P.Y. 74 | 90 | 8 | — | Dry pigment + water | Hydrated masterbatch | Tm + 10 |
| Toner 4 | Polyester resin/styrene-acrylic resin = 70/30 | P.Y. 74 | 97 | 10 | — | Dry pigment + water | Hydrated masterbatch | Tm + 20 |
| Toner 5 | Polyester resin/styrene-acrylic resin = 70/30 | P.Y. 73 | 98 | 11 | — | Dry pigment + water | Hydrated masterbatch | Tm + 20 |
| Toner 6 | Polyester resin/styrene-acrylic resin = 70/30 | P.Y. 73 | 98 | 11 | — | Dry pigment | Dry masterbatch | Tm + 40 |
| Toner 7 | Styrene-acrylic resin | P.Y. 73 | 98 | 11 | — | Dry pigment + water | Hydrated masterbatch | Tm + 20 |
| Toner 8 | Polyester resin/styrene-acrylic resin = 70/30 | P.Y. 73 | 110 | 14 | — | Dry pigment + water | Hydrated masterbatch | Tm + 20 |
| Toner 9 | Polyester resin/styrene-acrylic resin = 70/30 | P.Y. 73 | 98 | 11 | — | Dry pigment | Dry masterbatch | Tm + 20 |
| Toner 10 | Polyester resin/styrene-acrylic resin = 70/30 | P.Y. 73 | 95 | 10 | — | Paste pigment | — | Tm + 20 |
| Toner 11 | Polyester resin/styrene-acrylic resin = 70/30 | P.Y. 73 | 98 | 11 | Abiethyl amine | Dry pigment | Dry masterbatch | Tm + 40 |
| Toner 12 | Polyester resin/styrene-acrylic resin = 70/30 | P.Y. 174 | 110 | 14 | — | Dry pigment + water | Hydrated masterbatch | Tm + 20 |

TABLE 3

| | | Color hue in the powder state | | Charge response of the classified | Durability test | | | | | Difference in development contrast under N/L |
|---|---|---|---|---|---|---|---|---|---|---|
| | Toner | L* | b* | product | Change in charge | Fogging | Filming | OHP transmission | Irregular color | environment |
| Ex. 1 | 1 | 91.1 | 113.5 | A: 80.6% | A: 1.6 mC/kg | A: 0.4% | A | A: 91% | A | A: 0 V |
| Ex. 2 | 2 | 92.2 | 119.1 | A: 81.0% | A: 1.9 mC/kg | A: 0.4% | A | A: 92% | B | A: 0 V |
| Ex. 3 | 3 | 89.2 | 110.2 | B: 74.5% | A: 1.8 mC/kg | A: 0.5% | A | B: 84% | A | A: 5 V |
| Ex. 4 | 4 | 88.2 | 108.1 | B: 73.0% | A: 1.9 mC/kg | A: 0.5% | A | C: 78% | A | A: 5 V |
| Ex. 5 | 5 | 87.4 | 106.5 | B: 71.2% | B: 3.5 mC/kg | A: 0.5% | A | C: 71% | A | B: 10 V |
| Comp. Ex. 1 | 6 | 83.1 | 102.3 | C: 64.6% | C: 5.2 mC/kg | C: 1.4% | A | E: 44% | A | E: 45 V |
| Comp. Ex. 2 | 7 | 86.5 | 105.6 | E: 38.7% | E: 8.9 mC/kg | E: 2.6% | C | C: 69% | A | C: 25 V |
| Comp. Ex. 3 | 8 | 86.1 | 104.5 | B: 70.5% | B: 3.8 mC/kg | A: 0.6% | A | D: 56% | A | C: 20 V |
| Comp. Ex. 4 | 9 | 84.1 | 103.2 | B: 68.1% | B: 4.2 mC/kg | B: 1.0% | A | E: 49% | A | D: 35 V |

TABLE 3-continued

| | Toner | Color hue in the powder state L* | b* | Charge response of the classified product | Durability test Change in charge | Fogging | Filming | OHP transmission | Irregular color | Difference in development contrast under N/L environment |
|---|---|---|---|---|---|---|---|---|---|---|
| Comp. Ex. 5 | 10 | — | — | — | — | — | — | — | — | — |
| Comp. Ex. 6 | 11 | 84.0 | 104.0 | D: 50.6% | D: 7.1 mC/kg | D: 1.8% | E | D: 52% | A | E: 40 V |
| Comp. Ex. 7 | 12 | 84.9 | 103.4 | B: 69.2% | B: 3.9 mC/kg | B: 1.0% | A | D: 50% | A | E: 35 V |

EXAMPLE 6

An image was formed with Yellow Toner 1 and the cyan toner in accordance with one-component development system and it was evaluated. As a printer, "LBP-2510" (product of Canon) was used. As a result, it was rated as "A" in any one of OHP transmission, irregular color, filming and difference in development contrast and therefore satisfactory. Also in a change in charge and fogging after the printing durability test on 3,000 sheets, it was rated as "B" and therefore, satisfactory.

EXAMPLE 7

In the same manner as in the producing method of a cyan toner for comparison, which had been employed for the measurement of a difference in the development contrast, except for the use of Pigment Red 57:1 as a pigment, a magenta toner was obtained. An unfixed image was formed with the resulting magenta toner, the cyan toner and Yellow Toner 1 by "CLC-1000" (product of Canon) while using one power source for developing devices of these three colors, followed by fixation by "iRC3200" (fixing machine; product of Canon). As a result the reflection density of each color was 1.6±0.05, suggesting that no problem occurred in the use of only one power source.

This invention being thus described, it will be obvious that same may be varied in various ways. Such variations are not to be regarded as departure from the spirit and scope of the invention, and all such modifications would be obvious for one skilled in the art intended to be included within the scope of the following claims.

The invention claimed is:

1. A method for producing a toner comprising steps of:

heating and mixing a colorant and a part of a binder resin in the presence of water to obtain a hydrated color masterbatch having a water content of from 5 to 25% by mass;

melt-kneading at least the hydrated color masterbatch and the remaining part of the binder resin to obtain a kneaded product; and pulverizing the kneaded product.

2. The method for producing a toner according to claim 1, wherein the kneading temperature Tmix (° C.) of resin in the step of melt-kneading satisfies the following expression:

$$Tmix \leqq Tm+20$$

wherein, Tm (° C.) is a softening point of the binder resin.

3. The method for producing a toner according to claim 1, wherein:

the toner comprises a binder resin and a colorant;

the binder resin contains at least a polyester unit; and the toner is yellow toner, which in a powder state has a lightness L* satisfying the relationship of L*>87 and has a chromaticity b* satisfying the relationship of 106 <b*<120.

* * * * *